US011575231B2

(12) United States Patent
Lv et al.

(10) Patent No.: US 11,575,231 B2
(45) Date of Patent: Feb. 7, 2023

(54) ELECTRICAL CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Lai-Hang Lv, Kunshan (CN); De-Jin Chen, Kunshan (CN); Xian-Wei Feng, Kunshan (CN); Xian-Liang Zhang, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 101 days.

(21) Appl. No.: 17/145,417

(22) Filed: Jan. 11, 2021

(65) Prior Publication Data

US 2021/0218201 A1 Jul. 15, 2021

(30) Foreign Application Priority Data

Jan. 10, 2020 (CN) ..... 202010026385.4

(51) Int. Cl.
*H01R 13/627* (2006.01)
*H01R 13/6585* (2011.01)
(Continued)

(52) U.S. Cl.
CPC ..... *H01R 13/6585* (2013.01); *H01R 13/502* (2013.01); *H01R 13/6272* (2013.01); *H01R 12/79* (2013.01)

(58) Field of Classification Search
CPC ..... H01R 13/6585; H01R 13/502; H01R 13/6272; H01R 12/79; H01R 12/721;
(Continued)

(56) References Cited

U.S. PATENT DOCUMENTS 6,210,225 B1 * 4/2001 Cai ..... H01R 13/6582 439/607.53
6,257,913 B1 * 7/2001 Kropa ..... H01R 13/6275 439/353
(Continued)

FOREIGN PATENT DOCUMENTS

CN 202872038 U 4/2013
CN 106785613 A 5/2017
(Continued)

*Primary Examiner* — Abdullah A Riyami
*Assistant Examiner* — Nelson R. Burgos-Guntin
(74) *Attorney, Agent, or Firm* — Ming Chieh Chang

(57) ABSTRACT

A receptacle connector for mating with a plug connector having a mating tongue and a latch thereof, includes an insulative housing defining a mating slot extending along a longitudinal direction to receive the mating tongue of the plug connector, and an outer metallic shield defining a primary space to receive the housing and a secondary space communicatively beside the primary space to receive the latch of the plug connector. A plurality of contacts are disposed in the housing to mechanically and electrically connect to the mating tongue. An inner metallic shield is attached upon a long side of the housing to separate the primary space and the secondary space from each other in a transverse direction perpendicular to the longitudinal direction.

20 Claims, 11 Drawing Sheets

(51) Int. Cl.
*H01R 13/502* (2006.01)
*H01R 12/79* (2011.01)

(58) Field of Classification Search
CPC ..... H01R 13/6594; H01R 12/716; H01R 13/6275; H01R 13/648; H01R 13/516; H01R 24/005
See application file for complete search history.

(56) References Cited

U.S. PATENT DOCUMENTS 10,096,944 B2 * 10/2018 Huang ..... H01R 13/26
10,381,779 B2 * 8/2019 Zhou ..... H01R 12/79
10,601,181 B2 * 3/2020 Lu ..... H01R 13/6594
10,741,970 B1 * 8/2020 Liu ..... H01R 13/665
10,938,157 B2 * 3/2021 Yang ..... H01R 12/79
11,139,597 B2 * 10/2021 Hsiao ..... H01R 13/631
11,264,755 B2 * 3/2022 Te ..... H01R 43/20
2004/0058572 A1 * 3/2004 Fromm ..... H01R 13/6461 439/101
2004/0082215 A1 * 4/2004 Lee ..... H01R 13/6275 439/352
2005/0277334 A1 * 12/2005 Huang ..... H01R 12/00 439/607.01
2006/0063415 A1 * 3/2006 de Vanssay ..... H01R 13/6275 439/350
2006/0199418 A1 * 9/2006 Chang ..... H01R 13/6275 439/358
2009/0047825 A1 * 2/2009 Wu ..... H01R 13/504 439/680
2010/0248544 A1 * 9/2010 Xu ..... H01R 13/6658 439/607.04
2011/0306228 A1 * 12/2011 Wu ..... H01R 24/64 439/345
2012/0156900 A1 * 6/2012 Wu ..... H01R 13/6658 439/352
2013/0052851 A1 * 2/2013 Wang ..... H01R 13/6335 439/345
2014/0199874 A1 * 7/2014 Tseng ..... H01R 13/641 439/345
2016/0149341 A1 * 5/2016 Reed ..... H01R 13/6272 439/352
2018/0205179 A1 * 7/2018 Zhou ..... H01R 13/6593
2018/0212364 A1 * 7/2018 Huang ..... H01R 13/64
2018/0212376 A1 * 7/2018 Wang ..... H01R 13/6581
2018/0269607 A1 * 9/2018 Wu ..... H01R 12/7005
2018/0294592 A1 * 10/2018 Huang ..... H01R 13/6596
2019/0173232 A1 * 6/2019 Lu ..... H01R 13/6272
2020/0028302 A1 * 1/2020 Winey ..... H01R 13/6592
2020/0067221 A1 * 2/2020 Wang ..... H01R 12/79
2020/0076126 A1 * 3/2020 Yang ..... H01R 12/79
2020/0076132 A1 * 3/2020 Yang ..... H01R 12/73
2020/0144752 A1 * 5/2020 Liao ..... H01R 13/6272
2020/0194932 A1 * 6/2020 Henry ..... H01R 13/629
2020/0203867 A1 * 6/2020 Lu ..... H01R 12/716
2020/0321727 A1 * 10/2020 Li ..... H01R 13/6275
2021/0075159 A1 * 3/2021 Wang ..... H01R 13/6582
2021/0218197 A1 * 7/2021 Lv ..... H01R 12/79
2021/0218201 A1 * 7/2021 Lv ..... H01R 13/6272
2021/0367381 A1 * 11/2021 Lv ..... H01R 13/629
2021/0408727 A1 * 12/2021 Fan ..... H01R 12/7005
2022/0029360 A1 * 1/2022 Little ..... H01R 13/65914
2022/0077632 A1 * 3/2022 Chen ..... H01R 13/64
2022/0102888 A1 * 3/2022 Henry ..... H01R 13/424

FOREIGN PATENT DOCUMENTS

CN 304240766 S 8/2017
CN 208045830 U 11/2018
CN 208608459 U 3/2019
CN 209561681 U 10/2019
TW 499692 U 4/2015

* cited by examiner

ELECTRICAL CONNECTOR ASSEMBLY

BACKGROUND OF THE INVENTION

1. Field of the Invention

The present invention relates to an electrical contact assembly including mated receptacle connector and plug connector with the corresponding latching structure, and particularly to the receptacle having a fully intimately surrounding metallic shield for both mechanical reinforcement consideration and electrical shielding consideration. This invention is related to the copending application having the same inventors, the same applicant, the same title and the same filing date.

2. Description of Related Arts

China Patent No. CN208045830U disclosesa receptacle connector including an insulative housing with a receiving slot therein and a metallic shield enclosing the housing wherein one long side plate of the shield is spaced from the corresponding long side wall with a space therebetween in a transverse direction to allow a latch of the plug connector to be received within for latching. In other words, only three sides of the housing are intimately covered by and retained to the corresponding three side plates of the shield while the long side of the housing which communicatively faces toward the space is essentially exposed without proper protection either from the viewpoint of the electrical shielding effect or the mechanical reinforcing effect disadvantageously.

Therefore, it is desired to provide a receptacle connector with a fully intimately surrounding metallic shield while still maintain the corresponding latching mechanism for engagement with the latch of the plug connector.

SUMMARY OF THE INVENTION

A receptacle connector for mating with a plug connector having a mating tongue and a latch thereof, includes an insulative housing defining a mating slot extending along a longitudinal direction to receive the mating tongue of the plug connector, and an outer metallic shield defining a primary space to receive the housing and a secondary space communicatively beside the primary space to receive the latch of the plug connector. A plurality of contacts are disposed in the housing to mechanically and electrically connect to the mating tongue. An inner metallic shield is attached upon a long side of the housing to separate the primary space and the secondary space from each other in a transverse directionperpendicular to the longitudinal direction wherein the inner metallic shield may optionally form a cutout to compliantly accommodate the corresponding latch mechanism therein, and may optionally be equipped with an insulative tape on an inner surface to avoid any improper electrical connection risk between the inner metallic shield and the outwardly deflected contacts when the mating tongue of the plug connector is received and mated within the mating slot.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
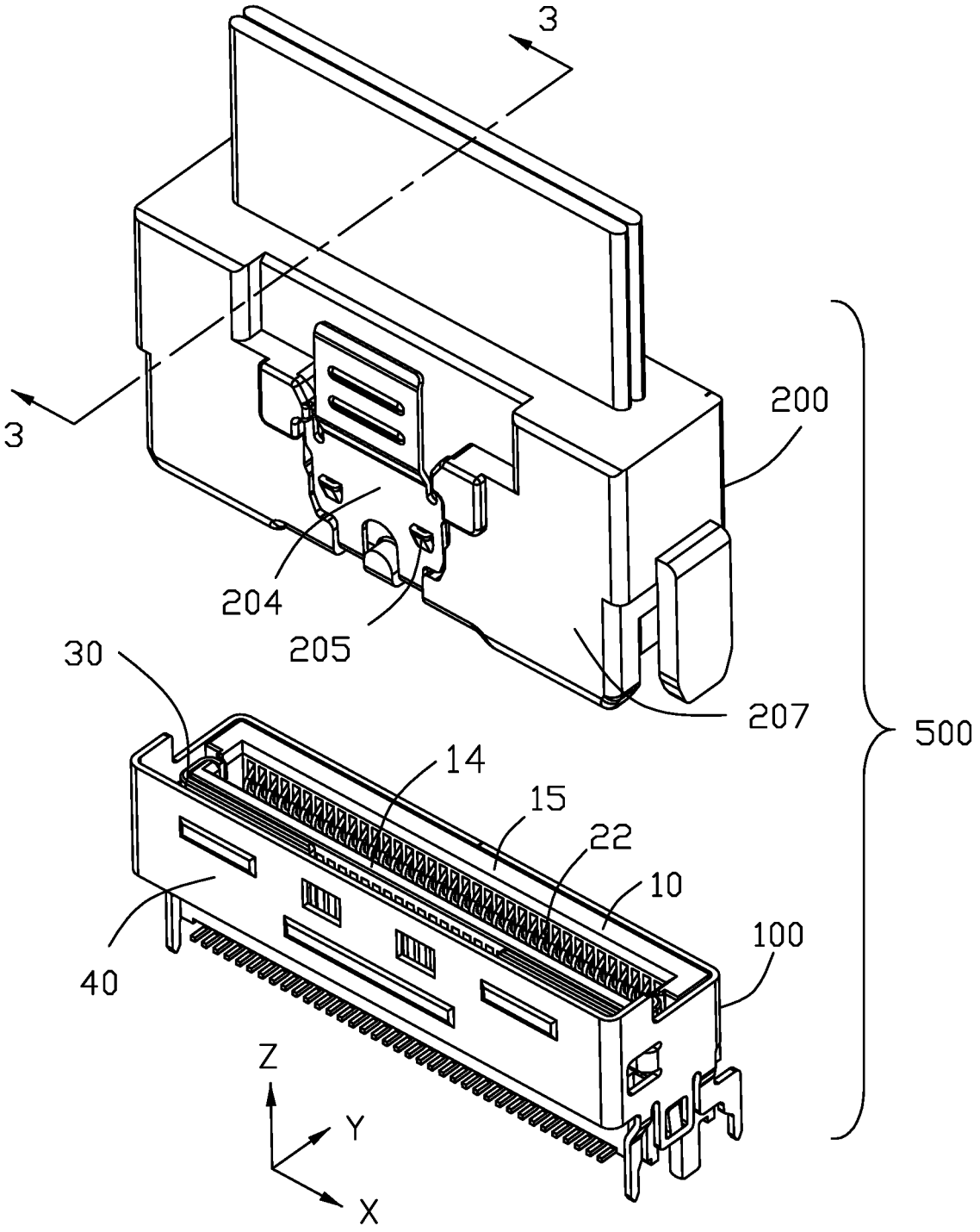
FIG. 1 is a perspective view of an electrical connector assembly including the receptacle connector and the plug connector adapted to be mated with each otherin a separated manner according to the invention.
Figure 2:
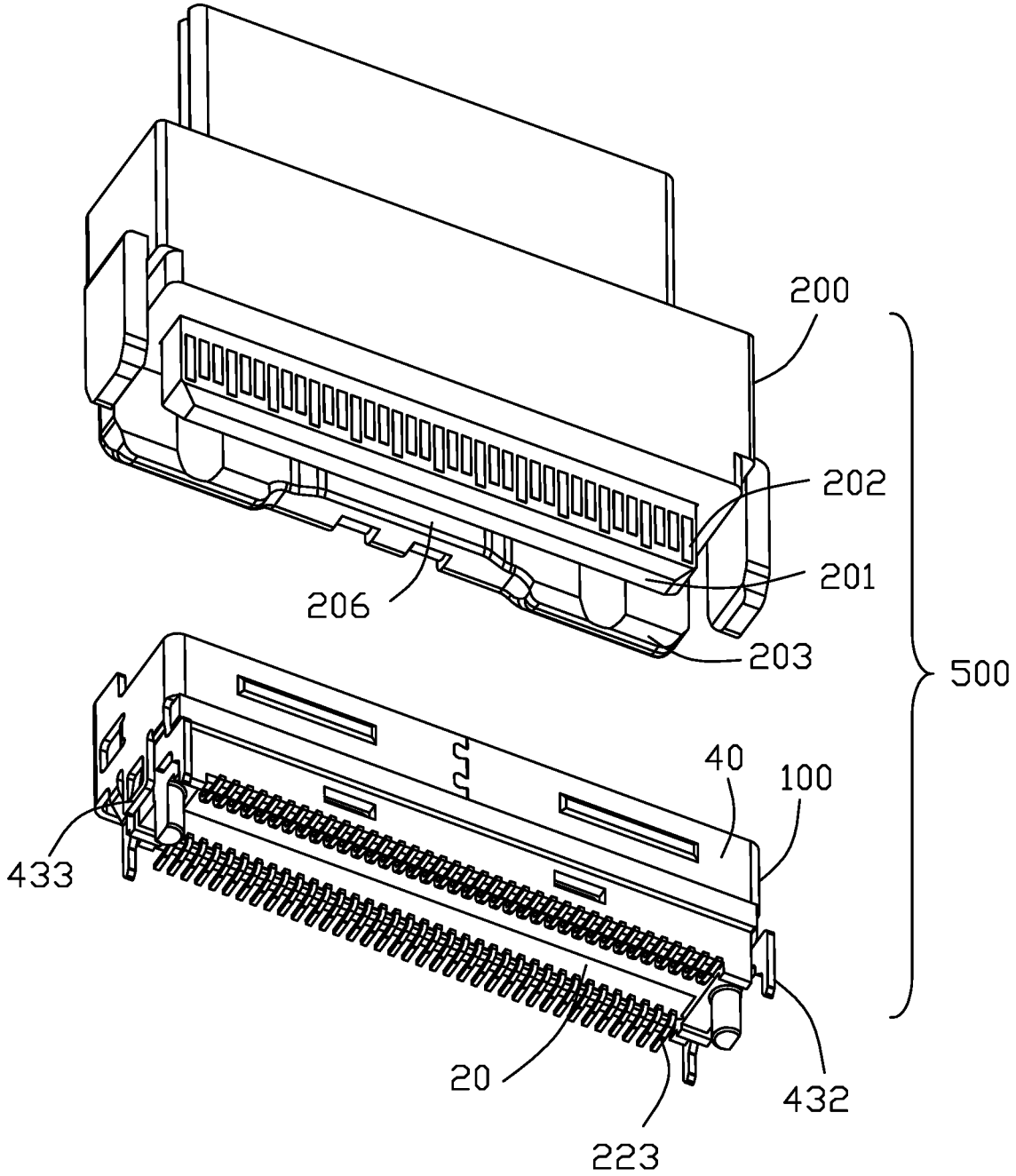
FIG. 2 isanotherperspective view of the electricalconnector assembly of FIG. 1.
Figure 3:
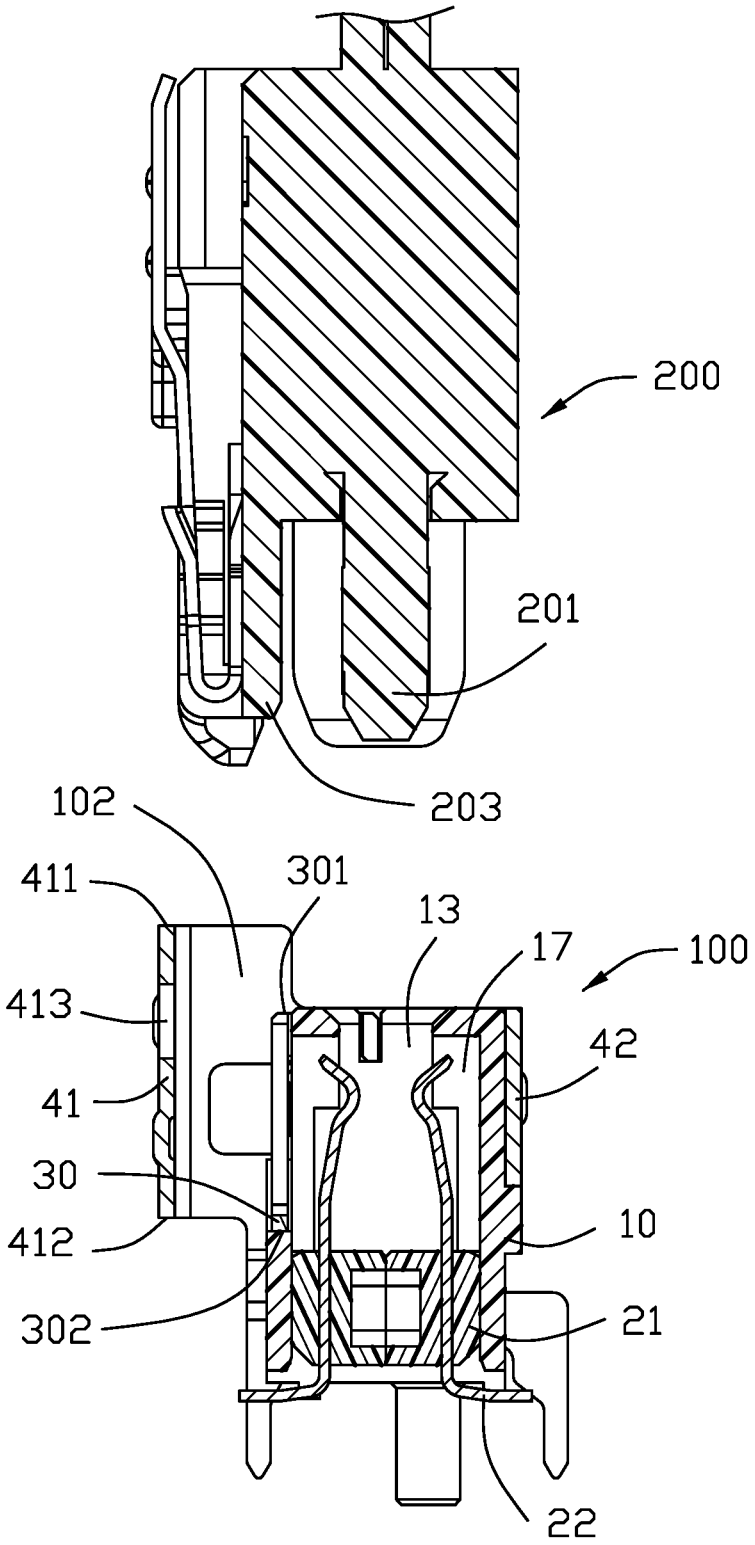
FIG. 3 is a cross-sectionalview of the electrical connector assembly of FIG. 1.
Figure 4:
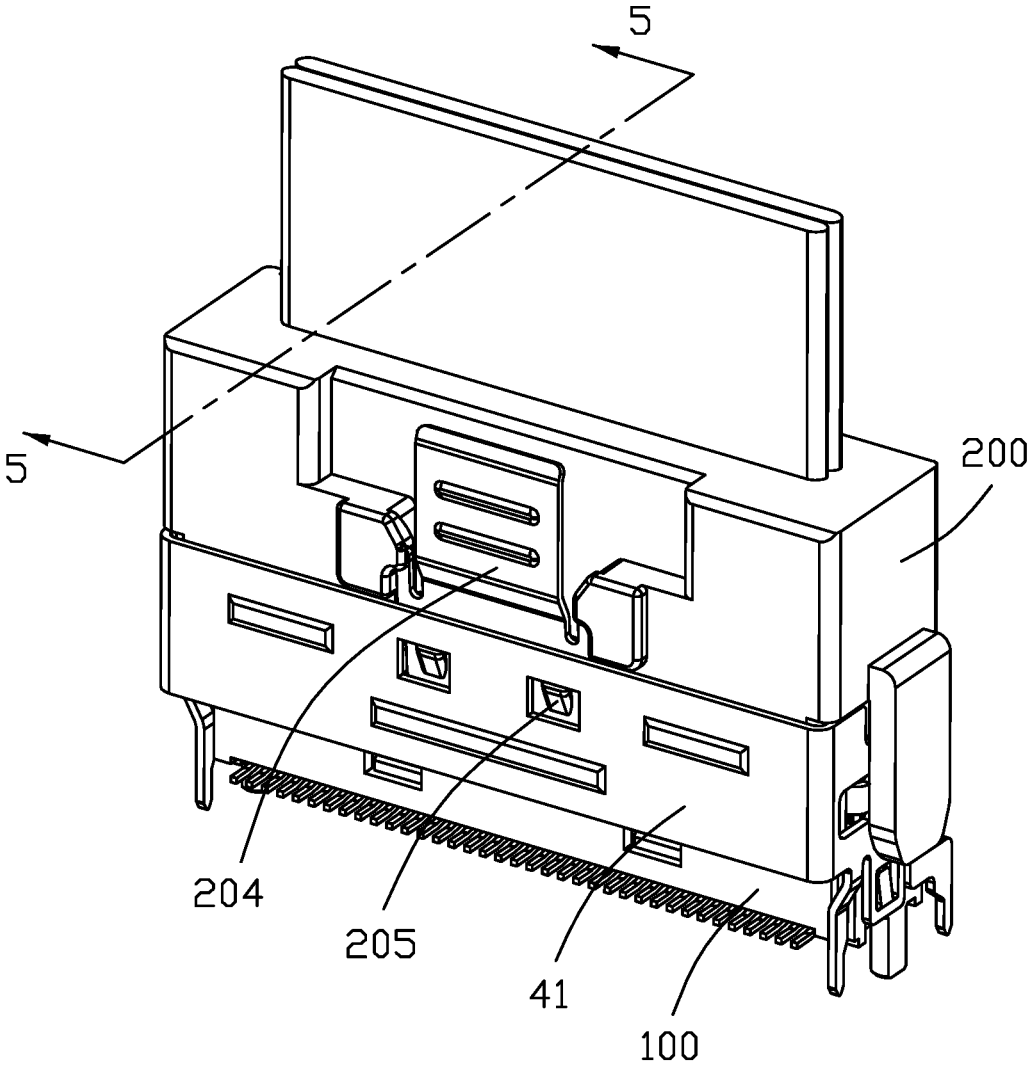
FIG. 4 is a perspectiveview of the electrical connector assemblyof FIG. 1 wherein the plug connector and the receptacle connector are mated with each other.
Figure 5:
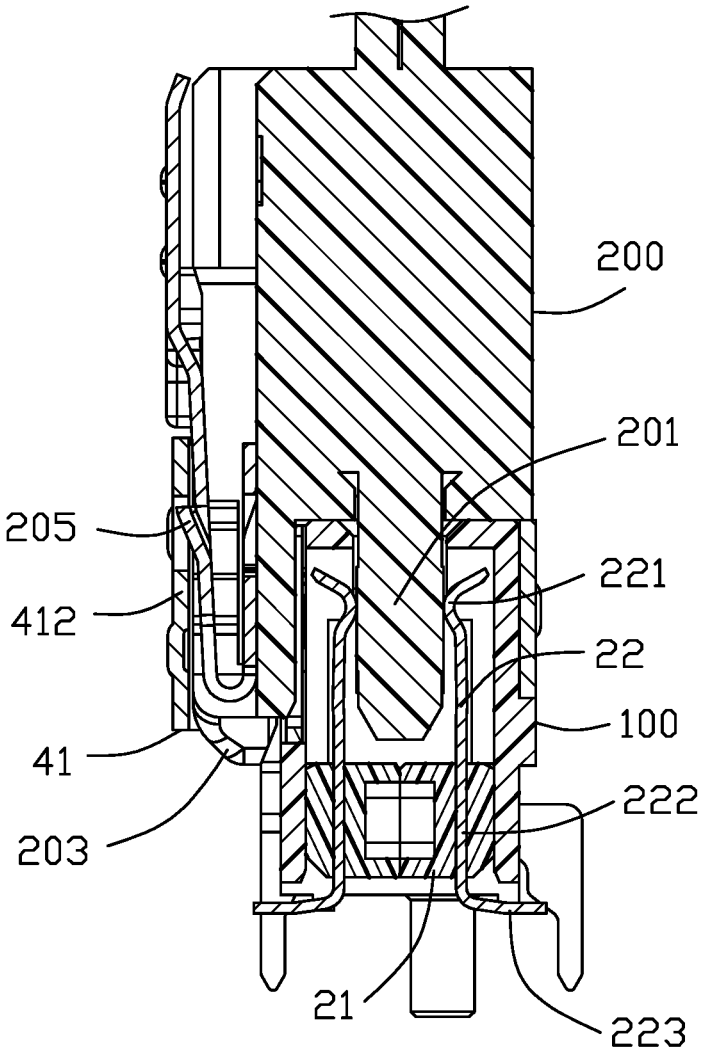
FIG. 5 is across-sectional viewof the electrical connector assembly of FIG. 4.
Figure 6:
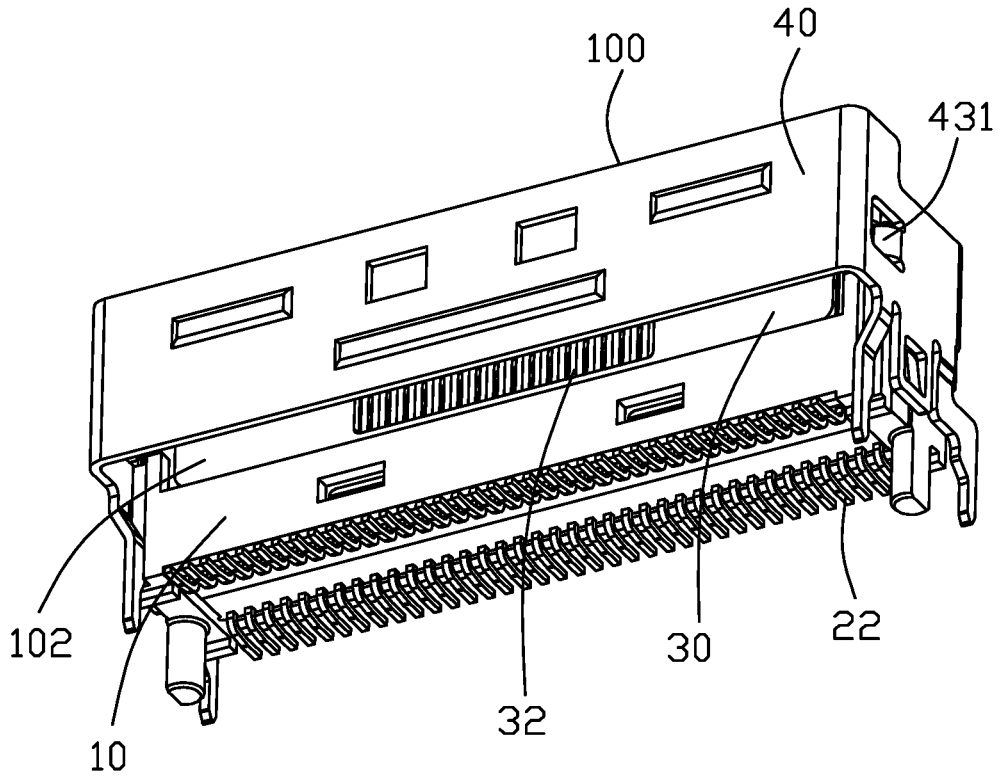
FIG. 6 is a perspectiveview ofthe receptacle connector of the electrical connector assembly of FIG. 1.
Figure 7:
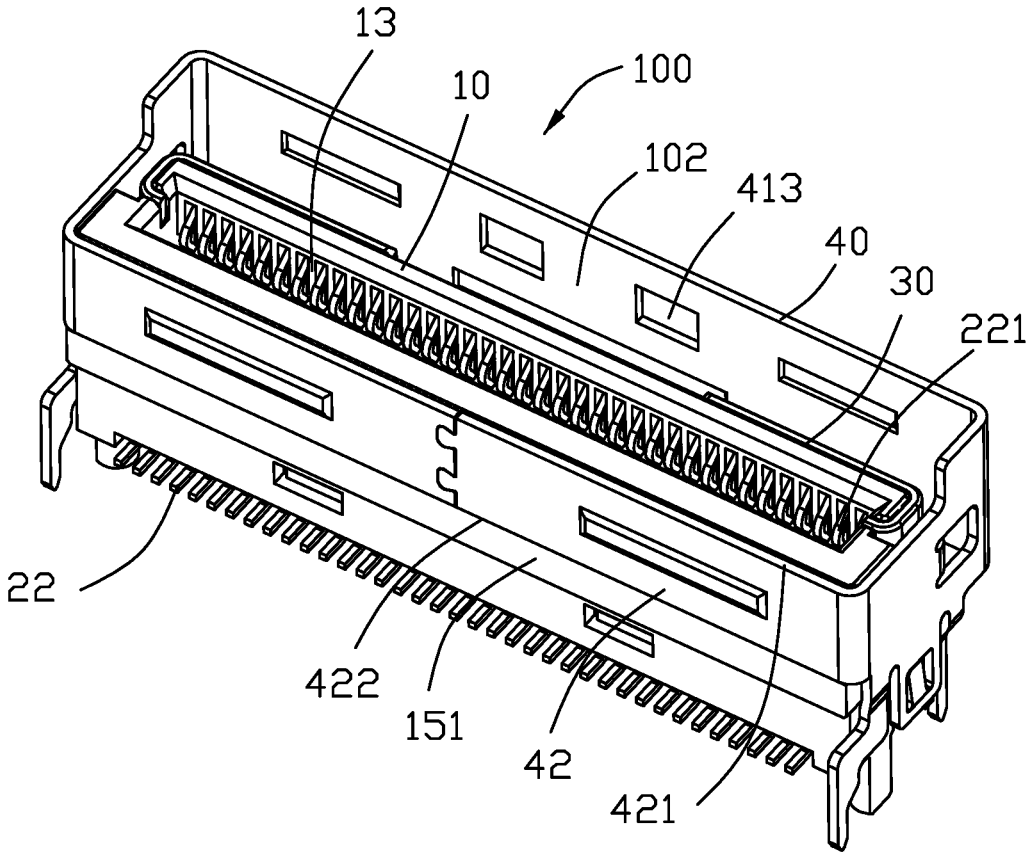
FIG. 7 is another perspective view of the receptacle connector of the electrical connector assembly of FIG. 6.
Figure 8:
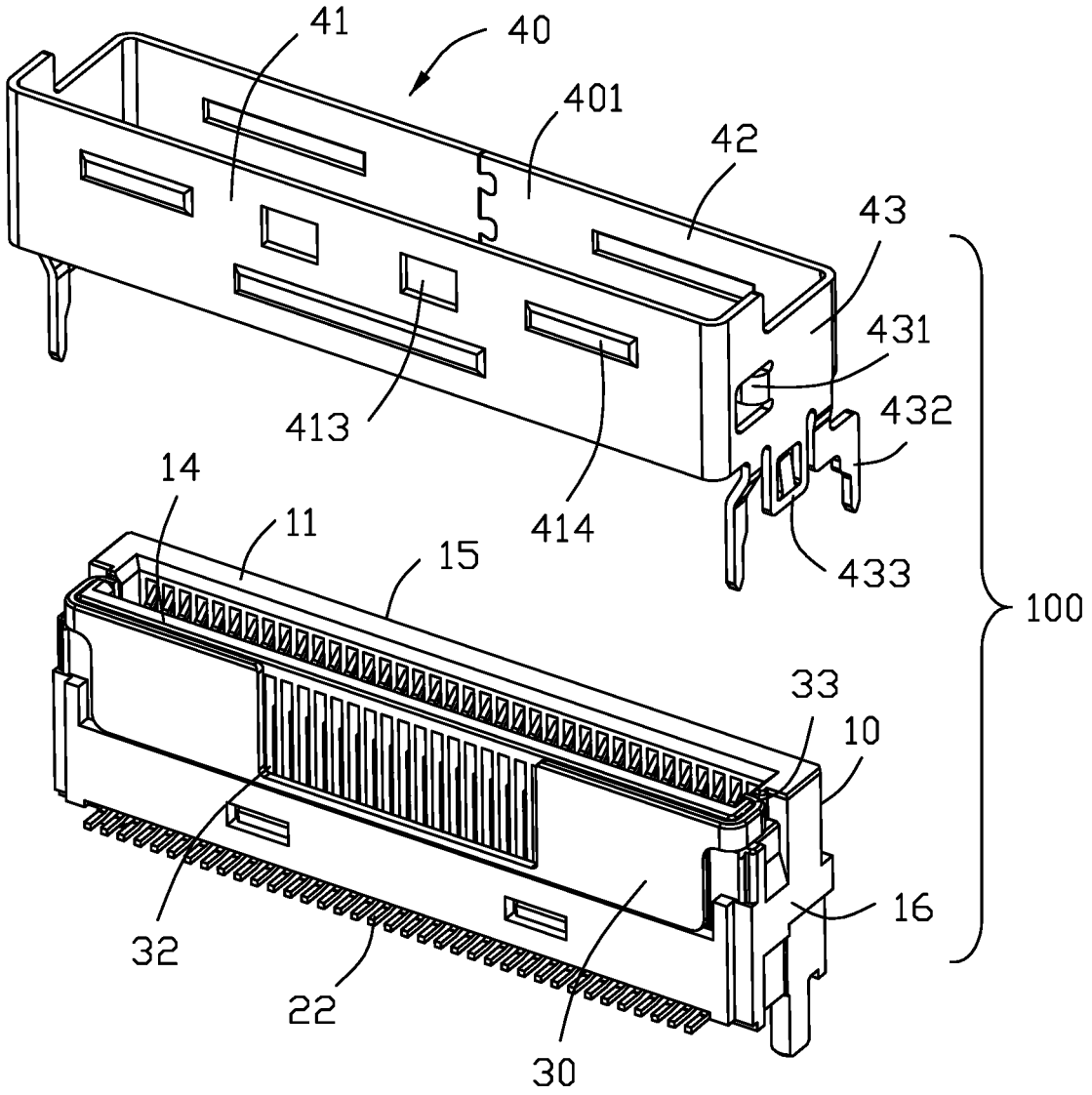
FIG. 8 is an exploded perspective view of the receptacle connector of the electrical connector assembly of FIG. 7.

An electrical connector assembly 500 includes a receptacle connector 100 and the plug connector 200 adapted to be connected with each other. In this embodiment, the electrical connector assembly belongs to MCIO (Mini Cool Edge IO). In this embodiment, the mating direction is the vertical direction.

As shown in FIGS. 1-5, the plug connector 200 includes a mating tongue 201 with a plurality of plug contacts 202 thereon, and an extending plate 203 parallel to the mating tongue 201 with a deflectable latch 204 thereon. The extending plate 203 extends forwardly beyond the mating tongue 201 in the vertical direction Z.

As further shown in FIG. 6-11, the receptacle connector 100 includes an insulative housing 10 enclosing a pair of contact modules 20, an outer metallic shield 40 surrounding the housing 10, and an inner metallic shield 30 attached upon one side of the housing 10.

The housing 10 includes a mating face 11 and a mounting face 12 opposite to each other in the vertical direction Z with a mating slot 13 extending along the longitudinal direction X and located under the mating face 11. A first side wall 14 and the second side wall 15 are respectively located by two sides of the mating slot 13 in the transverse direction Y. Each of the first side wall 14 and the second side wall 15 extends in the longitudinal direction X. A pair of end walls 16, are connected between opposite ends of the first side wall 14 and the second side wall 15 Each of the end walls 15 extends in the transverse direction Y. Each of the first side wall 14 and the second side wall 15 forms a plurality of passageways 17 to communicate with the mating slot 13 in the transverse direction Y.

The housing 10 forms a mounting cavity 18 above the mounting face 12 so as to have the pair of contact modules 20 upwardly assembled thereinto. Each contact module 20 includes a plurality of contacts 22 integrally formed within an insulator 21 via insert-molding. Each insulator 21 includes corresponding coupling blocks 211 and the openings 212 so as to have the pair of contact modules 20 assembled together. Each insulator 21 further includes a plurality of protrusions 213 engaged within the corresponding holes 141 in the first side wall 14 and the second side wall 15 for fixing the pair of contact module 20 within the mounting cavity 18 of the housing 10. Each contact 22 includes an upper contacting section 221 extending into the mating slot 13, a lower mounting section 223 around the mounting face 12, and a middle retaining section 222 therebetween.

Figure 9:
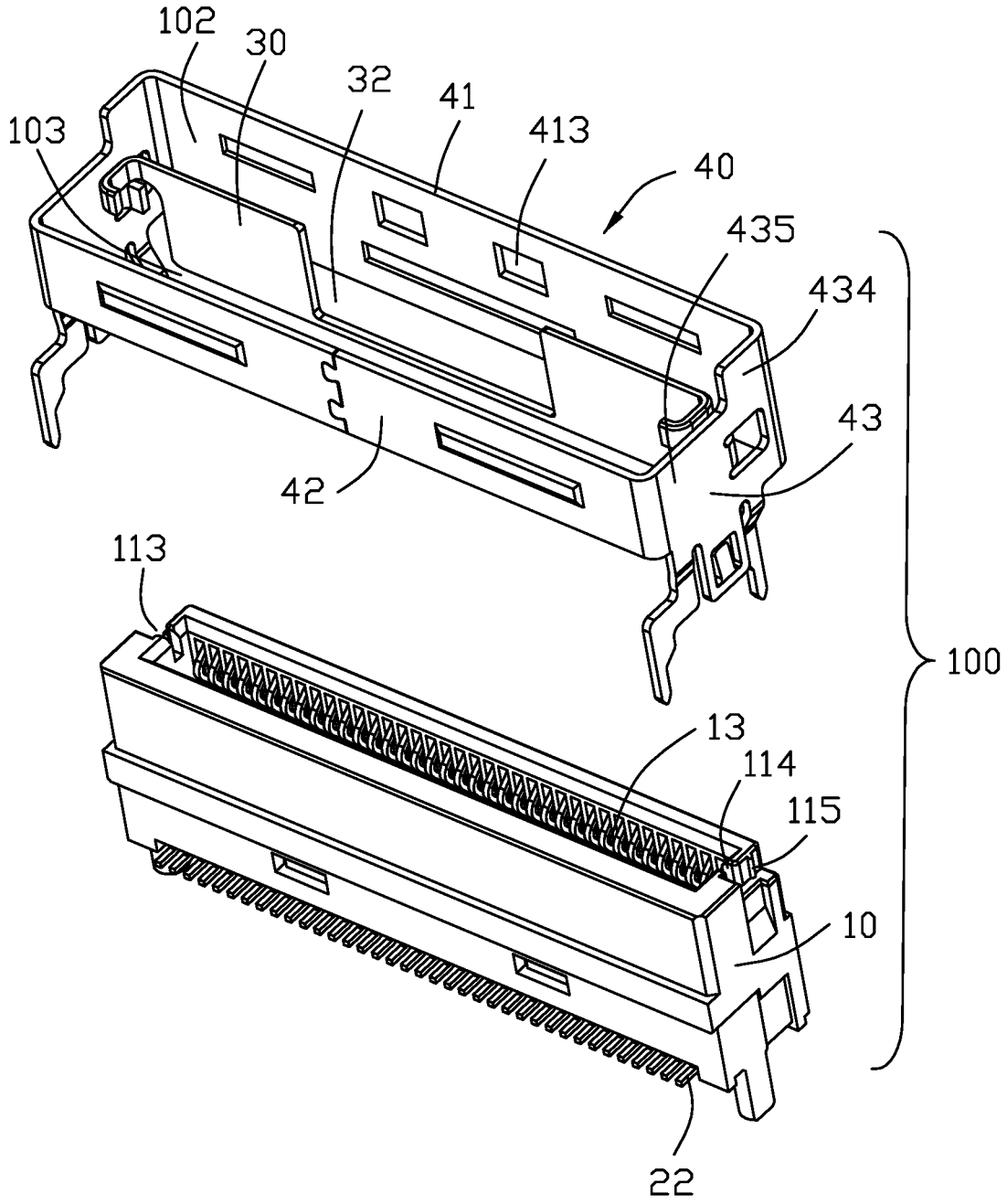
FIG. 9 is another exploded perspective view of the receptacle connector of the electrical connector assembly of FIG. 8.
Figure 10:
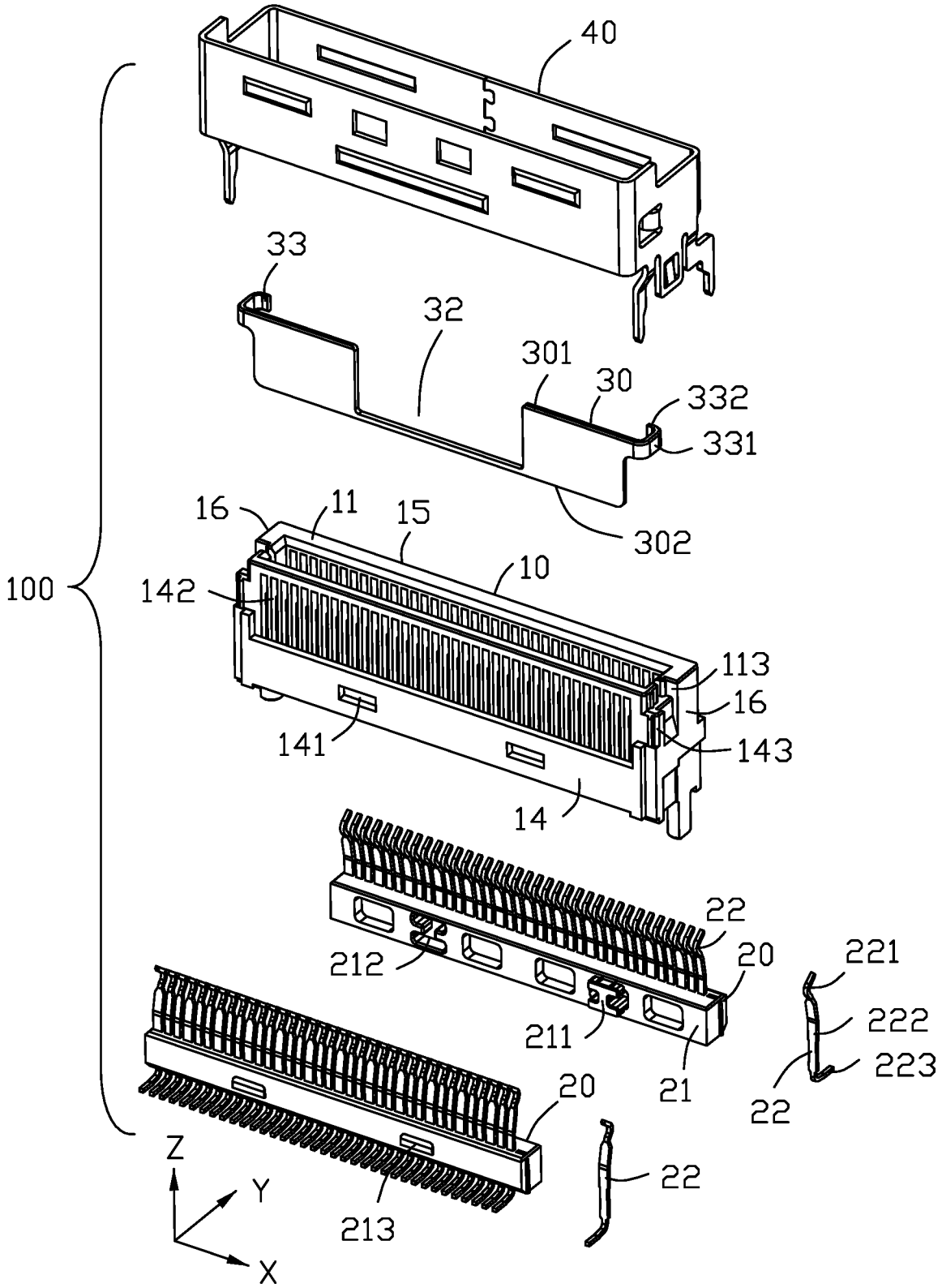
FIG. 10 is a further exploded perspective view of the receptacle connector of the electrical connector assembly of FIG. 8.
Figure 11:
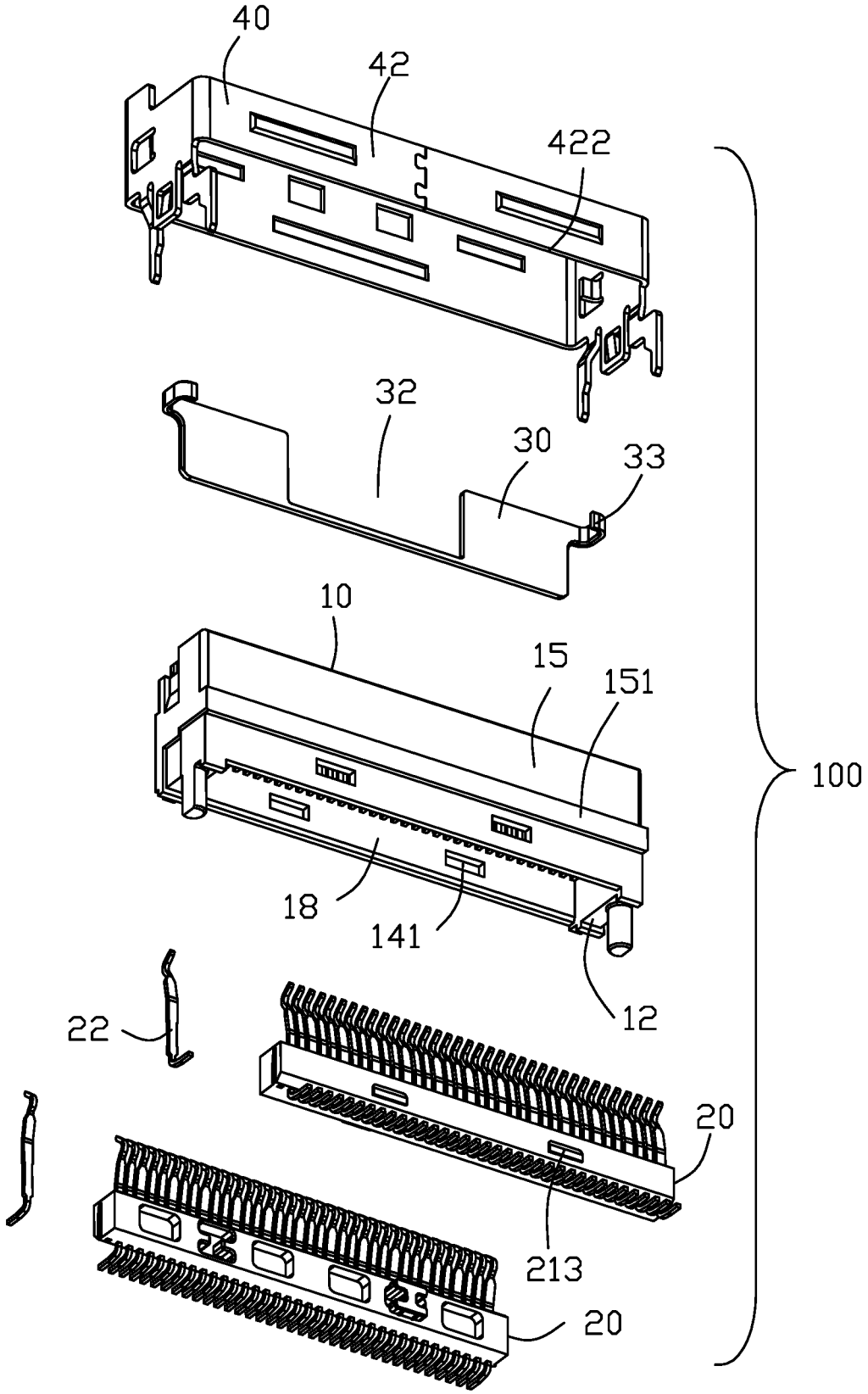
FIG. 11 is another exploded perspective view of the receptacle connector of the electrical connector assembly of FIG. 10.

The outer metallic shield 40 includes a first side plate 41 extending in the longitudinal direction X and spaced from the first side wall 14, a second side plate 42 extending along in the longitudinal direction X parallel to the first plate 41 and intimately covering the second side wall 15, and a pair of end plates 43 spaced from each other over in the longitudinal direction in a parallel relation and intimately covering the end walls 16, respectively. All the first plate 41, the second side plate 42 and the pair of end plates 43 commonly form a receiving space 401 including, along the transverse direction Y, a primary/dwelling space 103 for retaining the housing 10 therein to form the complete receptacle connector 100, and a secondary/locking space 102 communicatively beside the primary space for receiving the extending plate 203 of the plug 200 during mating. The first side plate 41 includes a pair of locking holes 413 for engagement with the locking lugs 205 of the latch 204 of the plug connector 200. Both the first side plate 41 and the second side plate 42 includes protrusions 414 for reinforcement consideration. The inner metallic shield 30 is attached upon an exterior surface of the first side wall 14 to face the secondary space 102. As shown in FIG. 9, by the inner metallic shield 30, the receiving space 401 of the outer metallic shield 40 is divided into the primary space 103 and the secondary space 102.

The upper edge 411 of the first side plate 41 is higher than both the upper face 11 and the upper edge 301 of the inner metallic shield 30, and the lower edge 412 is higher than the lower edge 302 of the inner metallic shield 30. In a side view, the mating face 11 is located between an upper edge and the lower edge of locking hole 413in the vertical direction Z. Each end plate 43 includes a first portion 434 connected to the first side plate 41 facing the secondary space 102 in the longitudinal direction, and a second portion 435 intimately covering the corresponding end wall 16. In other words, generally speaking the primary space 103 is formed among the first side plate 41, the first portions 434 of the pair of end plates 43 and the inner metallic shield 30, and the secondary space 102 is formed among the second side plate 42, the second portions 435 of the pair of end plates 43 and the inner metallic shield 30. The upper edge 301 of the inner metallic shield 30 is flush with or lower than the mating face 11, and the lower edge 302 of the inner metallic shield 30 is located above the mounting face 12. The upper edge of the first portion 434 is higher than that of the second portion 435 and but being flush with the upper end of the 411 of the first side plate 41.

The exterior surface of the first side wall 14 forms a recess 142 to accommodate the inner metallic shield 30 so as not to increase the dimension with regard to the housing 10 in the transverse direction Y, thus assuring the second space 102 may keep the original dimension for receiving the extending plate 203 of the standard plug connector 200 without improper interference. A cutout 32 is formed in the inner metallic shield 30 to communicate the primary space 103 and the secondary space 102 in the transverse direction Y. The locking holes 413 in the first side plate 41 are essentially aligned with the cutout 32 in the transverse direction. Understandably, the inner metallic shield 30 may include the protrusions similar to protrusions 414 on the outer metallic shield 40 for increasing engagement with the plug connector 200. In this embodiment, an inner surface of the inner metallic shield 30 may be applied with an insulative tape for avoiding any improper electrical connection between the inner metallic shield 30 and the outwardly deflected contacts 22 when the plug connector 200 is mated with the receptacle connector 100.

In this embodiment, both the inner metallic shield 30 and the outer metallic shield 40 are discrete from each other and assembled downwardly to the housing 10 by hooks 33. The hooks 33 includes a first section 331 and a second section 332, and the end wall 16 of the housing 10 forms a first portion 113 and the second portion 114 to receive the first section 331 and the second section 332. The end wall 16 further includes a rib 115 for increasing tension with the hook 33. The inner metallic shield 30 and the outer metallic shield 40 are electrically connected via the first portion 331 of the inner metallic shield and the end plate 43 of the outer metallic shield 40.

The end wall 16 further forms a rib 143 below the first portion 113 in the vertical direction, and the end plate 43 forms an engagement tab 431 grasping upon the rib 143 and located below the corresponding hook 33.

The end plate 43 includes a pair of legs 432 for mounting to the printed circuit board (not shown), and an engagement tab 433 between the pair of legs 432 to upwardly abut against a step (not labeled) of the end wall 16 for preventing upwardly movement of the outer metallic shield 40 from the housing 10. The second side wall 15 includes a supporting bar 151 on which the lower edge 422 of the second side plate 42 downwardly abuts for preventing downward movement of the outer metallic shield 40 from the housing 10.

As shown in FIGS. 1-5, when the plug connector 200 is mated with the receptacle connector 100, the extending plate 203 firstly enters the secondar space 102 and the mating tongue 201 successively enters the primary space 103. When the plug connector 200 and the receptacle connector 100 are fully mated with each other, the bottom edge of the extending plate 203 is located and exposed below the lower edge 413 of the first side plate 41 so as to indicate the full mating therebetween. The locking lug 205 of the latch 204 is engaged within the corresponding locking hole 413. The extending plate 203 further includes an inward protrusion 206 opposite to the latch 204 to be snugly received within the cutout 32 of the inner metallic shield 30 so as to stabilize the mating between the plug connector 200 and the receptacle connector 100.

Compared with the traditional receptacle connector as shown in the aforementioned CN208045830U, in the instant invention the receptacle connector 100 is further equipped with an inner metallic shield 30 to divide the receiving space into the primary space 103 for receiving the housing 10, and a secondary space 102 for receiving the extending plate 203 of the plug connector 200 wherein the first side wall 14 forms the recess 142 to accommodate the inner metallic shield 30 for not affecting the secondary space 102 due to the inner metallic shield 30 in the transverse direction Y.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

a receptacle connector including:

an insulative housing with a first side wall and a second side wall spaced from each other in a parallel relation with a mating slot therebetween in a transverse direction, the mating slot extending in a longitudinal direction perpendicular to the transverse direction and upwardly exposed to an exterior in a vertical direction perpendicular to both the transverse direction and the longitudinal direction;

a plurality of passageways formed in each of the first side wall and the second side wall;

a plurality of contacts disposed in the corresponding passageways respectively, each of the contacts including a contacting section extending into the mating slot in the transverse direction;

an outer metallic shield defining a primary space and a secondary space side by side arranged with each other in the transverse direction, wherein the primary space is adapted to receive the housing and the secondary space is adapted for receiving a plug connector;

said outer metallic shield including a first side plate and a second side plate spaced from each other in the transverse direction in the parallel relation, wherein the housing is received within the primary space with the second side plate intimately covering an exterior surface of the second side wall while the first side plate being spaced from the first side wall with said secondary space therebetween in the transverse direction; and an inner metallic shield being discrete from the outer metallic shield and positioned upon an exterior surface of the first side wall to directly face the secondary space opposite to the first side plate in the transverse direction.

2. The electrical connector assembly as claimed in claim 1, wherein the first side plate forms a pair of locking holes, and the inner metallic shield forms a cutout aligned with the pair of locking holes in the transverse direction.

3. The electrical connector assembly as claimed in claim 2, wherein said cutout extends through an upper edge of the inner metallic shield.

4. The electrical connector assembly as claimed in claim 1, wherein the inner metallic shield includes two hooks at two opposite ends in the longitudinal direction, and the housing includes a pair of end walls in the longitudinal direction to retain the corresponding hooks thereto respectively.

5. The electrical connector assembly as claimed in claim 4, wherein the outer metallic shield includes a pair of end plates at two opposite ends in the longitudinal direction with corresponding engagement tabs thereon to retain to the end walls, respectively, and the engagement tabs are located below the corresponding hooks, respectively, in the vertical direction.

6. The electrical connector assembly as claimed in claim 5, wherein each end plate forms a pair of legs with an engagement tab therebetween to upwardly abut against a step of the housing for preventing upward movement of the outer metallic shield from the housing.

7. The electrical connector assembly as claimed in claim 6, wherein the second side wall forms a bar against which a bottom edge of the second side plate downwardly abuts for preventing downward movement of the outer metallic shield from the housing.

8. The electrical connector assembly as claimed in claim 1, wherein the plug connector is adapted to be mated with the receptacle connector, the plug connector includes a mating tongue adapted to be received within the mating slot during mating, and an extending plate equipped with a latch thereon and adapted to be received within the secondary space with locking lugs of the latch engaged within corresponding locking holes in the first side plate during mating, and the extending plate of the plug connector further includes an inward protrusion adapted to be received within the cutout during mating.

9. The electrical connector assembly as claimed in claim 1, wherein the inner metallic shield and the outer metallic shield are electrically connected with each other around opposite ends of the housing in the longitudinal direction.

10. The electrical connector assembly as claimed in claim 2, wherein the plug connector is adapted to be mated with the receptacle connector, the plug connector includes a mating tongue adapted to be received within the mating slot during mating and an extending plate equipped with a latch thereon and adapted to be received within the secondary space with locking lugs of the latch engaged within corresponding locking holes in the first side plate during mating, and a bottom edge of the extending plate of the plug connector is exposed under a bottom edge of the first side plate of the outer metallic shield in the vertical direction during mating.

11. An electrical connector assembly comprising:

a receptacle connector and a plug connector adapted to be mated with each other in a vertical direction, the plug connector including a mating tongue and an extending plate spaced from each other in a transverse direction perpendicular to the vertical direction, the extending plate being equipped with a latch;

the receptacle connector including:

an insulative housing defining a mating slot extending along a longitudinal direction perpendicular to both the vertical direction and the transverse direction for receiving the mating tongue of the plug connector, a first side wall and a second side wall located by two sides of the mating slot in the transverse direction;

a plurality of contacts retained to the first side wall and the second side wall;

an outer metallic shield forming a receiving space;

an inner metallic shield being discrete from the outer metallic shield and located in the receiving space and dividing, in the transverse direction, the receiving space into a primary space in which the housing is received, and a secondary space adapted to receive the extending plate of the plug connector; wherein the outer metallic shield forms a locking hole adapted to receive a corresponding locking lug of the latch of the plug connector.

12. The electrical connector assembly as claimed in claim 11, wherein the extending plate of the plug connector further includes an inward protrusion, and the inner metallic shield forms a cutout adapted to receive the inward protrusion therein during mating.

13. The electrical connector assembly as claimed in claim 12, wherein the housing of the receptacle connector forms a recess to receive the inner metallic shield therein.

14. The electrical connector assembly as claimed in claim 12, wherein the locking hole is aligned with the cutout in the transverse direction.

15. The electrical connector assembly as claimed in claim 11, wherein the inner metallic shield is secured to the housing of the receptacle connector.

16. The electrical connector assembly as claimed in claim 15, wherein the inner metallic shield forms a pair of hooks at two opposite ends in the longitudinal direction to secure to two opposite end walls of the housing of the receptacle connector.

17. The electrical connector assembly as claimed in claim 16, wherein the outer metallic shield forms a pair of engagement tabs at two opposite ends in the longitudinal direction to secure to the two opposite end walls of the housing of the receptacle connector.

18. The electrical connector assembly as claimed in claim 17, wherein the pair of hooks are located above the pair of engagement tabs in the vertical direction perpendicular to both transverse direction and the longitudinal direction.

19. The electrical connector assembly as claimed in claim 11, wherein the inner metallic shield and the outer metallic shield are electrically connected with each other around two opposite ends of the housing.

20. The electrical connector assembly as claimed in claim 11, wherein the outer metallic shield forms a pair of mounting legs with an engagement tab therebetween to upwardly abut against a step of the housing for preventing upward movement of the outer metallic shield from the housing, and the housing forms a bar against which a bottom edge of the outer metallic shield abuts for preventing downward movement of the outer metallic shield from the housing.

* * * * *